United States Patent [19]

Hulber, Jr.

[11] 4,282,988

[45] Aug. 11, 1981

[54] APPARATUS FOR FACILITATING FLOW OF SOLID PARTICLES BY GRAVITY THROUGH A CONTAINER HAVING AN OPENING IN THE BOTTOM THEREOF

[75] Inventor: Clarence E. Hulbert, Jr., Muskogee, Okla.

[73] Assignees: Burch I. Williams, Tulsa; B. J. Malouf, Muskogee, both of Okla. ; part interest to each

[21] Appl. No.: 714,134

[22] Filed: Aug. 13, 1976

[51] Int. Cl.[3] ..... B65D 88/28

[52] U.S. Cl. ..... 222/184; 222/462

[58] Field of Search ..... 259/180, 4 R; 222/184, 222/185, 564, 459, 460, 462; 193/32; 302/64; 214/17 A, 17 R, 17 C; 141/343, 344; 105/247; 110/108; 298/24–29

[56] References Cited

U.S. PATENT DOCUMENTS

| | | | |
|---|---|---|---|
| 1,020,602 | 3/1912 | Hamrick | 222/460 X |
| 1,565,915 | 12/1925 | Dunkerley | 222/462 X |
| 3,071,297 | 1/1963 | Lee | 222/462 |
| 3,940,037 | 2/1976 | Watson | 222/564 |

*Primary Examiner*—Stanley H. Tollberg

*Attorney, Agent, or Firm*—Richards, Harris & Medlock

[57] ABSTRACT

An apparatus for facilitating the flow of solid particles in bulk form by gravity through a container within which the particles are temporarily stored or through a pipe within which the particles are being moved by force feeding or induced methods. The apparatus is a multisurfaced body the surfaces of which are described by curves in both vertical and horizontal directions. These curves may be cycloidal, hyperbolic or parabolic, among others. However, in its preferred embodiment the apparatus is generated by cycloidal curves. The curves in the vertical and horizontal directions converge toward the center and bottom of the container or pipe, and serve to interrupt the consolidating forces generated within the container or pipe which, absent the presence of the apparatus, would cause clogging or hindrance of the flow of material through the container or pipe.

8 Claims, 13 Drawing Figures

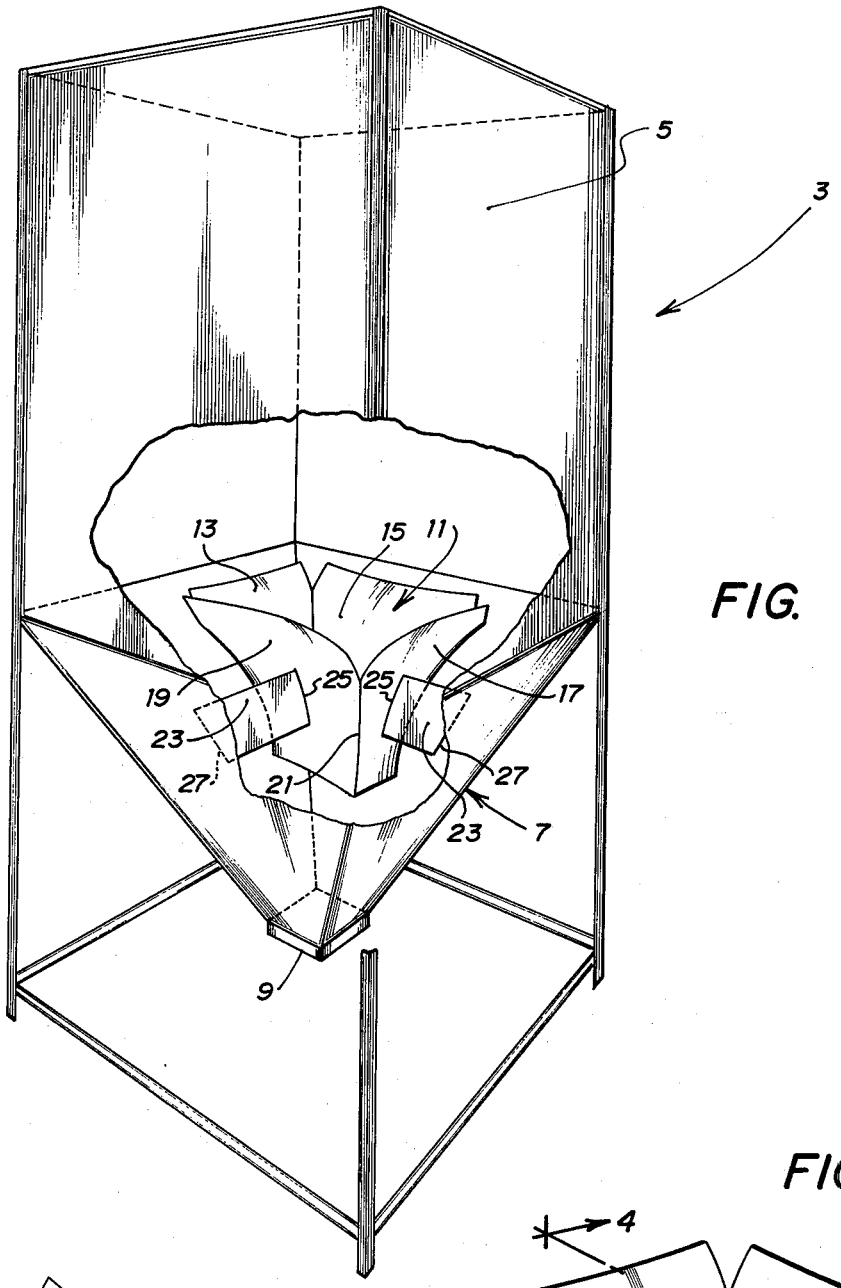
FIG. 1
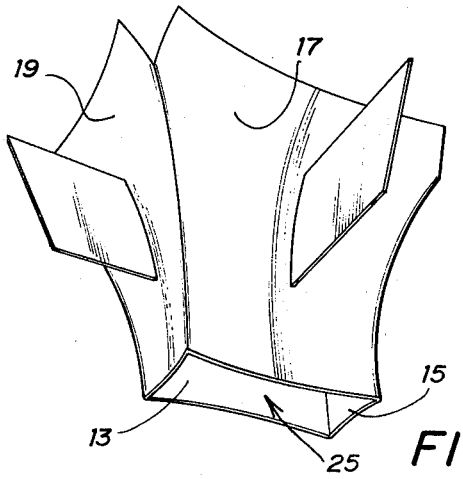
FIG. 2
FIG. 3
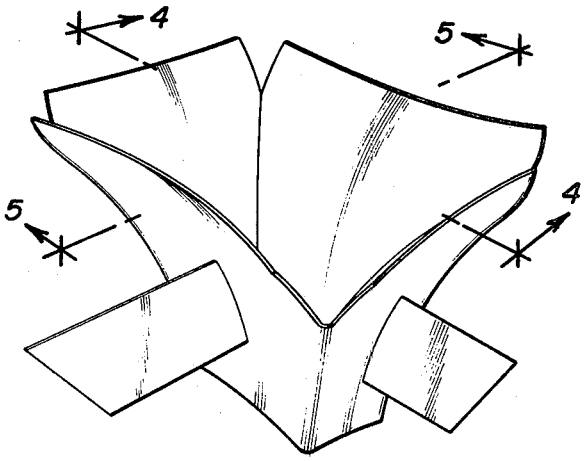

APPARATUS FOR FACILITATING FLOW OF SOLID PARTICLES BY GRAVITY THROUGH A CONTAINER HAVING AN OPENING IN THE BOTTOM THEREOF

BACKGROUND OF THE INVENTION

In many industrial applications it is common to store solid particles in bulk form within a container such as a silo or bunker which has a bin portion (the top part of the container) and hopper (the bottom part of the container). The hopper normally has converging surfaces which terminate in an opening through which the solid particles are to be discharged on an intermittent or continuous basis. In the storing of solid particles in bulk form within containers for subsequent discharge through an opening in the container, various flow problems are often encountered if the physical dimensions of the container have not been correctly designed or are inachievable under present technology for the particular material being handled. In some instances the material will form a bridge, arch, or pipe which obstructs the flow of material from the container. The stability of this obstruction depends upon properties which are controlling the formation of such an obstruction. These properties are normally (but not restricted to) the adhesion between the material and the wall of the container and the internal friction of the particles (a function of size, shape and moisture content of the material). The form of the container is also a material factor. Containers of optimum design can be fabricated for some, but not all, bulk solids if the appropriate physical properties of the solid particles are identified and properly considered during the initial design of the container. An example of one method for determining optimum dimensions for a container for a given material is described in A. W. Jenike, Storage and Flow of Solids, Bulletin 123, Utah Engineering and Experiment Station, University of Utah, 1964.

However, it is not uncommon to find containers which have been incorrectly designed or containers which were designed for one material and are being used for another material having different physical properties. It is also possible to encounter materials for which a suitable container design cannot (with state-of-the-art knowledge) be reached. It is possible in some instances to determine which conditions promote the bridging, arching or piping of the material. A full discussion of the techniques for identifying these conditions and locating them within a given bin or hopper can be found in the Jenike bulletin identified above.

When flow problems are encountered it is often necessary to improve the flowability of the bulk solid in the existing container. Various methods have been proposed for this purpose. One such method involves placement of a flow-corrective insert in the container. These inserts may take the form of a guideplate, tube, spiral chute or cascade conveyers. Use of conical inserts has been suggested and the design and dimensioning of such inserts is described in J. R. Johanson, The Use of Flow-Corrective Inserts in Bins, J. Eng. Ind. (May, 1966).

Other approaches have been proposed and used. These include mechanical devices which are fixed to the wall of the container such as vibrators, inflatable pads inside the containers and the placing of pipes within the containers through which air or other gas may be directed to fluidize the particles and improve their flowability. However, the auxiliary devices mentioned above are not in all instances satisfactory. Many of the flow problems mentioned above can be solved with the present invention which may be inserted into existing containers, without altering the exterior shape of the container, to promote the flow of bulk solid particles by interrupting, in a novel manner, consolidating forces which, absent the apparatus, could cause bridging, arching or piping of the material or in some manner limit or stop flow of the bulk solid particles.

SUMMARY OF THE INVENTION

The present invention is an apparatus for facilitating the flow of bulk solid particles through or from a container or flow directing device such as a pipe, bin or hopper by the use of multisurfaced bodies the surfaces of which are described by curves in both vertical and horizontal planes. The apparatus are placed within the container as flow directing devices at the point or points at which flow could otherwise become obstructed. In the preferred embodiment the multisurfaced body has four separate walls, the inner and outer surfaces of which are generated by cycloidal curves. The lateral edges of the four walls are in proximate abutting relationships. The lower portion of the walls defines an inner opening and an outer domain through which the material may flow. The walls of the body interrupt the stress field in the container and flow is possible because forces acting on the particles in proximity to the body are insufficient to cause consolidation of the solid particles. Particles may flow along the outer surfaces of the walls because they are unimpeded by forces from above.

BRIEF DESCRIPTION OF THE DRAWINGS

FIG. 1 is a perspective view of an apparatus according to the present invention shown in position within a container having a hopper generally square in cross section;

FIG. 2 is a perspective view of the flow facilitating apparatus of the present invention;

FIG. 3 is a top perspective view of the device of FIG. 2;

DESCRIPTION OF PREFERRED EMBODIMENT

Figure 4:
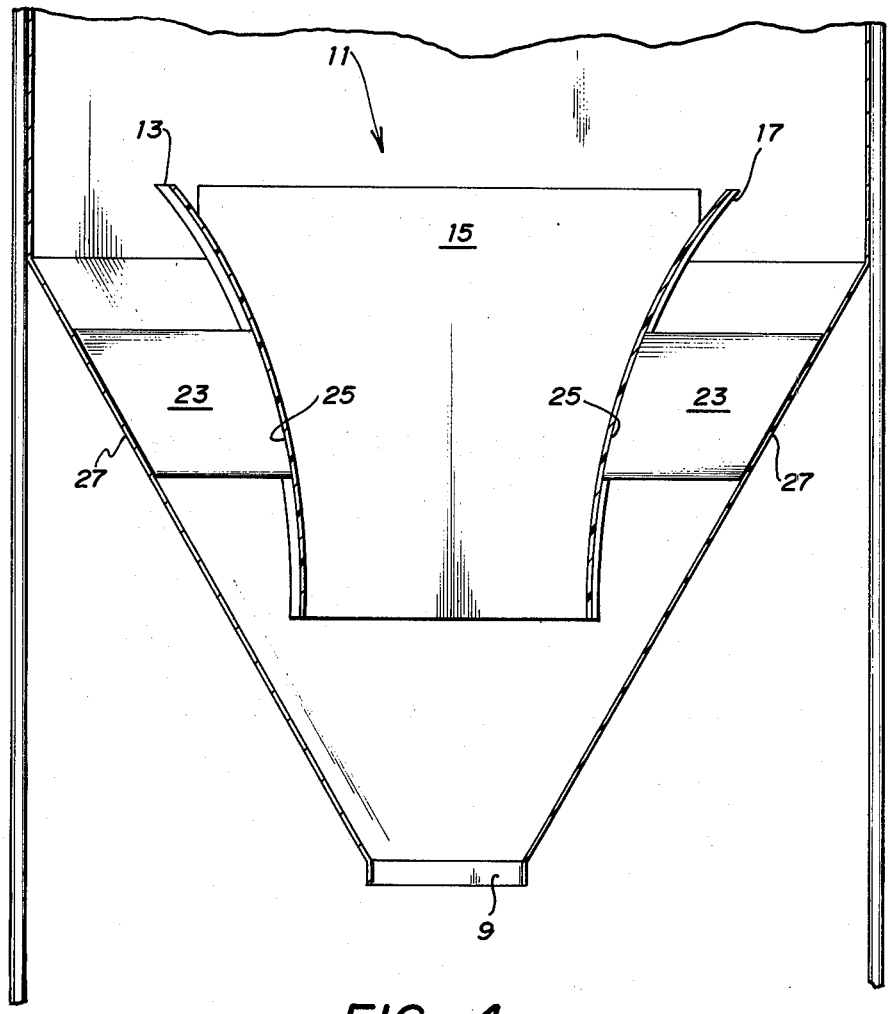
FIG. 4 is a cross-sectional view of the flow facilitating apparatus of the present invention along line 4—4 of FIG. 3.
Figure 5:
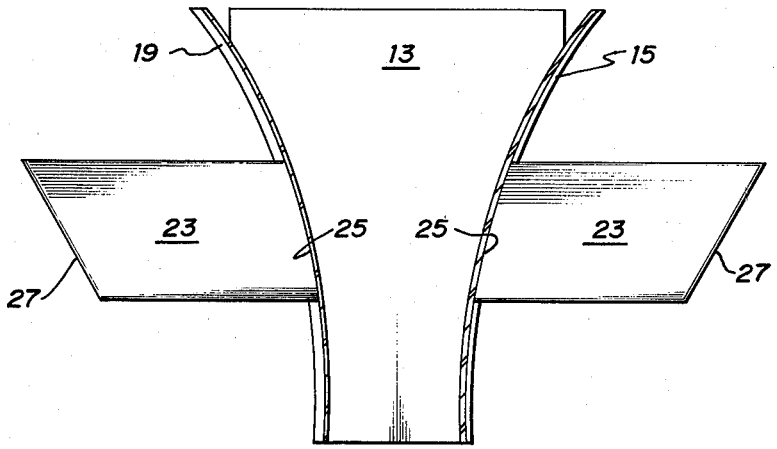
FIG. 5 is a cross-sectional view along line 5—5 of FIG. 3.

With reference to FIG. 1, the container 3 has a bin portion 5 generally square in cross section and a hopper 7 which converges to an opening 9, the flow through which may be controlled by any type of conventional valve (not illustrated). Situated within container 3 and extending partially upwardly into bin 5 and downwardly into hopper 7 is an apparatus for facilitating flow of solid particles stored within bin 5. The apparatus, generally indicated by the reference numeral 11, has four walls 13, 15, 17 and 19 which are joined along a portion of their lateral margins, as at corners 21. The apparatus 11 is positioned within container 3 and retained in a centrally located position by support panels 23 which are affixed to walls 13, 15, 17 and 19 at one end and extend outwardly to engage the walls of hopper 7 at the opposite ends 27. These panels are oriented to expose a minimum of surface area which could block flow by gravity within the container, as illustrated in FIG. 1. The surfaces, inner and outer, of walls 13, 15, 17 and 19 are defined by cycloidal curves which, as illustrated in FIGS. 1–3, converge toward the center and bottom of container 3. The cycloidal curves in the horizontal and vertical planes have the same curvature. The apparatus 11 is located within container 3 so that the walls 13, 15, 17 and 19 will interrupt the consolidating stress field generated by the solid particles within container 3. That is, from studies done by others it is possible to determine the point or points within a container where bridging or arching of a given material will occur. The techniques by which this determination is made are known by others skilled in the art and are described in A. W. Jenike, Storage and Flow of Solids, Bulletin 123, Utah Engineering and Experiment Station, University of Utah, 1964, and in an earlier work by him entitled Gravity Flow of Bulk Solids, Bulletin 108, Utah Engineering and Experiment Station, University of Utah, 1961. By placing the apparatus within the container at these points flow of the solid particles will be facilitated because walls 13, 15, 17 and 19 interrupt the stress field at a critical point where a bridge or dome would normally form and prevent formation of such domes or arches. Flow is possible because the forces acting on particles in proximity to the inner and outer walls of apparatus 11 will permit the particles to fall by gravity through both the inner and outer domains of the device to the outlet 9 unimpeded by forces from above which might tend to otherwise compact or consolidate them. Details of the analysis of the bin 15 and determination of the parameters of apparatus 11 will be described below in a more specific manner. Generally, however, the apparatus 11 is so constructed that the opening in the bottom end thereof, generally identified by the reference numeral 25, will have an area equal to or greater than the critical area of the material-container domain. More specifically, for any given container configuration and material there is, as is known by those skilled in the art, a critical area which must be provided at the outlet of the container before flow can occur. The techniques for determining this critical area are known to those skilled in the art and are described, for example, in A. W. Jenike, Gravity Flow of Bulk Solids, Bulletin 108, Utah Engineering and Experiment Station, University of Utah, 1961, pp. 231–236. Thus, generally, one may effectively design and utilize the apparatus of the present invention by first determining, according to techniques described in the art, the location within the container 3 at which bridging of a material may be expected to occur, given the container configuration and material physical properties. Walls having surfaces described by cycloidal curves both in a horizontal and vertical direction are then assembled at their edges to form a converging funnel-like structure which converges toward the center and bottom of the container to define at its lowermost end an opening 25 having an area greater than the critical area necessary for flow from a container with a given configuration with the material to be handled. The apparatus 11 is so positioned within the container 3 that its walls 13, 15, 17 and 19 interrupt the radial stress field at the point where consolidation will occur, i.e., at the point where bridging or arching will occur, thus permitting flow by gravity of the particles within the region of the apparatus 11 through the outlet 9 of the container 3.

While the above is a general description of the manner in which consolidating areas may be located and the physical shape and size of the flow facilitating apparatus of the present invention determined, reference is made to FIGS. 6–10 and the following description for a more technical and detailed description of a method of dimensioning an apparatus embodying the present invention.

Figure 6:
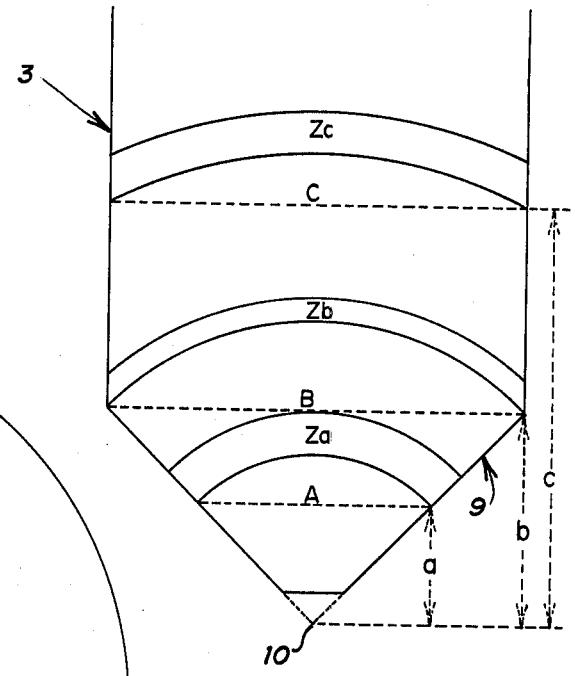
FIG. 6 is a schematic representation of a container.

The container 3 may be schematically represented, and FIG. 6 is such a representation. Zones where consolidation of materials can occur causing flow problems are identified as Za, Zb and Zc. The locations of these zones are identified (as stated above) by techniques known to those experienced with bulk solid particle flow restriction/stoppage. Specifically, these areas may be identified by physical measurement, or by any of a number of empirical techniques which may be found in the literature. See either of the articles by A. W. Jenike identified above for an acceptable empirical technique for identifying these zones. In FIG. 6, A represents a plane cut through the lower terminus of zone Za located a distance a from the vertex 10 of the hopper, while B represents a plane cut through the lower terminus of zone Zb located a distance b from the vertex of the hopper 7, and C, similarly, identifies a plane situated a distance c from the vertex of the hopper 7. Preferably an apparatus should be constructed and located as described below for each zone of flow restriction, such as zones Za, Zb and Zc. For the sake of simplicity the method for determining the dimensions of an apparatus for use in only one zone, namely zone Za, will be described. In determining dimensions, the letter A′ will represent a dimension of the plane A. Where A is a circular shape, A′ is the internal diameter of the circle. Where A is a square shape, A′ is the length of an internal side of the square. Where A is a rectangular shape, A′ is the length of an internal width of the rectangle. For other cross-sectional areas A, A′ is a similar internal dimension.

Figure 7:
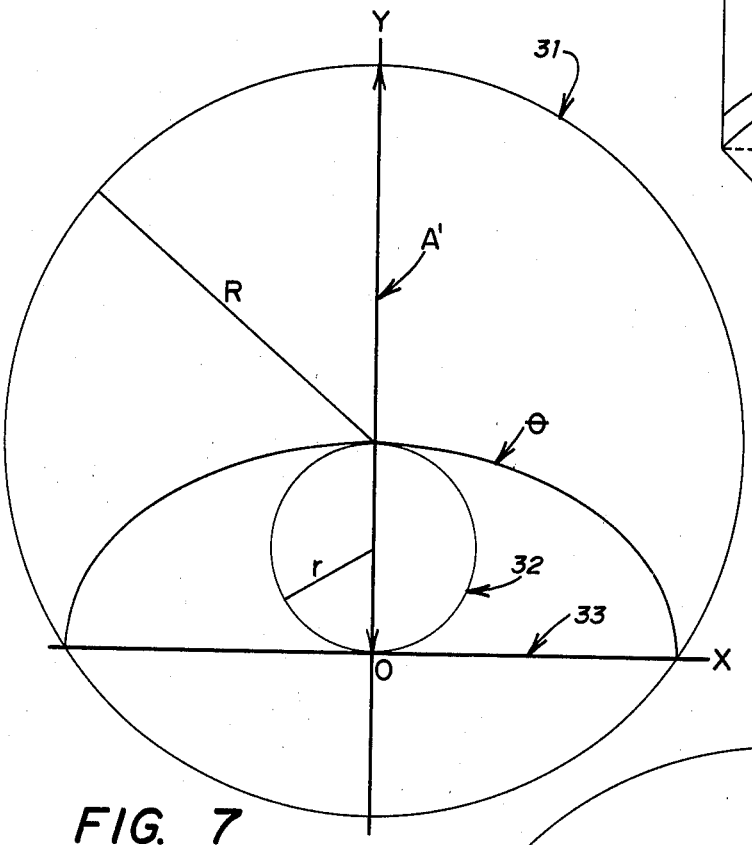
FIGS 7–12 are geometric forms used in determining dimensions of an apparatus embodying the present invention.

In order to construct a device of optimum dimensions to eliminate any flow blockage at zone Za, and with reference to FIG. 7, first construct a circle 31 with diameter A′, where A′ is the parameter identified above. Next, draw the vertical diameter A′. Construct a circle 32 which, with its diameter coincident with that of circle 31 and its circumference touching the center of circle 31, may be used to generate a cycloid by rolling along a chord of circle 31 such that the cusps of the cycloid thus generated will intercept the circle 31 at the point of intersection of the chord and the circumference of circle 31. Those familiar with mathematics will recognize that if the radius of circle 32 is r and the radius of circle 31 is R then:

$$\gamma = \frac{R}{\sqrt{4+\pi^2}} \cong \frac{R}{3.728} \cong 0.268R \cong 0.134A'$$

Having thus determined the radius and therefrom the diameter of circle 32, it may be constructed as described above and a line can then be constructed tangent to circle 32 at the lowest point o at which diameter A′ intersects the circumference of circle 32. A segment of the line so drawn will be a chord of circle 31 and will have a length within circle 31 equal to the circumference of circle 32. A cycloid is then constructed along chord 33 using the appropriate dimensions from circle 32 in one of any of a number of techniques known to those skilled in mathematics.

Figure 8:
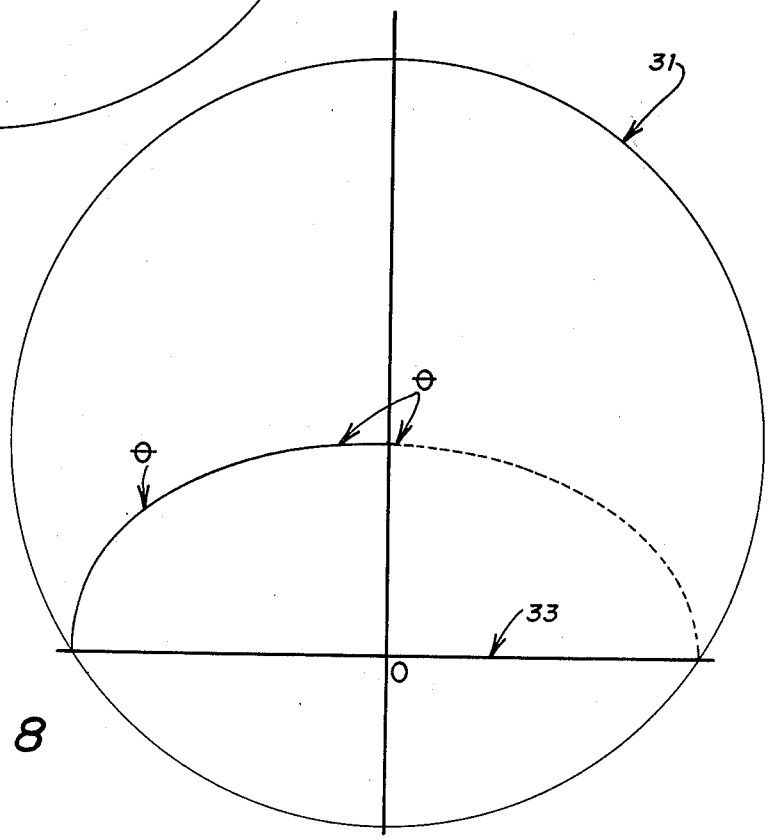
Figure 10:
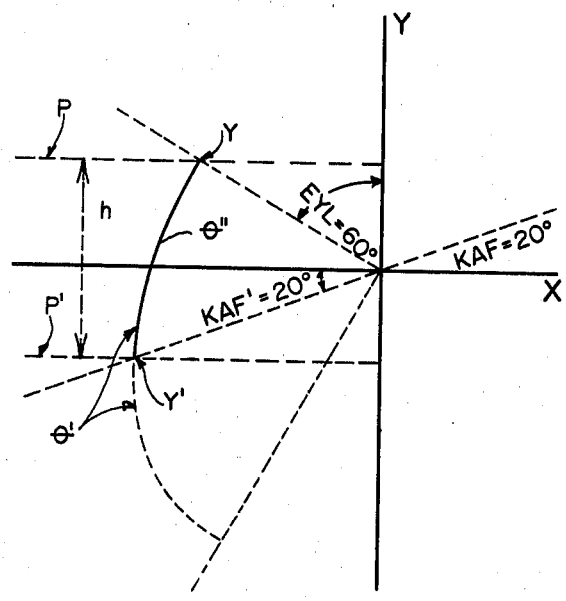
Figure 9:
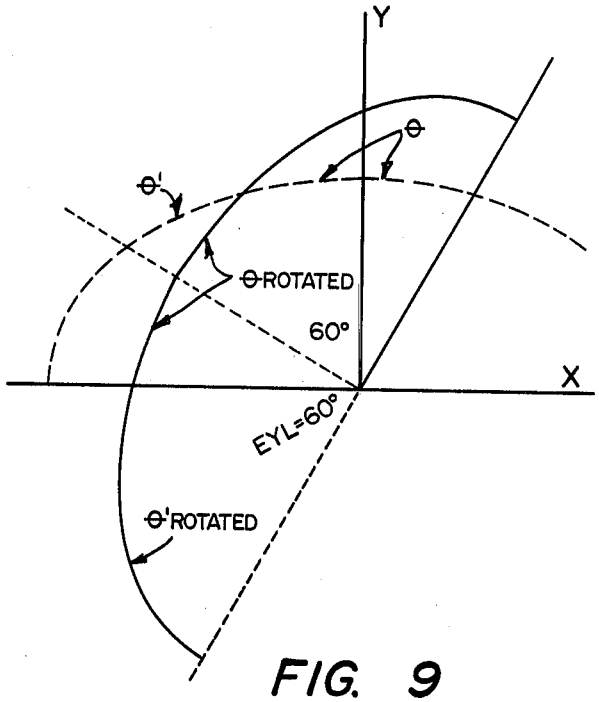

FIGS. 7 and 8 illustrate a cycloid $\theta$ constructed as described above with an arc of $\theta$, $\theta'$, identified in FIG. 8 as that portion of $\theta$ in the upper left hand quadrant of the coordinate system. It is necessary to determine the "effective yield locus" of the material which one wishes to cause to flow. The "effective yield locus", EYL, can be determined in the manner described in the later Jenike bulletin and is expressed in degrees of a circle. With knowledge of the "effective yield locus", $\theta$ and its arc, $\theta'$, the arc $\theta'$ is rotated counterclockwise around point o, a number of degrees equal to the "effective yield locus". This rotation may be accomplished by any of a number of techniques familiar to those knowledgeable in mathematics. For present purposes, a hypothetical "effective yield locus" of 60° is assumed, and the rotation is accomplished by graphical techniques. FIG. 9 illustrates arc $\theta$ and the chord segment $\theta'$ prior to (in phantom line) and following (in solid line) the 60° rotation. Next, it is necessary to determine the "kinematic angle of friction" KAF between the bulk solid particles and the container wall. A technique for determining the "kinematic angle of friction" is also disclosed in the later Jenike bulletin. The "kinematic angle of friction" is measured in degrees of a circle. For exemplary purposes, a hypothetical "kinematic angle of friction" of 20° has been assumed. With the above geometric figures having been constructed and the "effective yield locus" and "kinematic angle of friction" having been determined, the height of the apparatus is determined as follows. FIG. 10 is prepared to represent the rotated arc segment $\theta'$ and the coordinate axes. On FIG. 10 the "kinematic angle of friction" KAF and its reciprocal KAF' are drawn. Then the line defining KAF' is extended past its intersection y' with arc $\theta'$. The vertical height h of the apparatus is determined by drawing a perpendicular p' to the y axes such that it passes through y' and a perpendicular p to the y axes such that it passes through the upper extremity y of arc $\theta'$ as shown in FIG. 10. The portion of the arc $\theta'$ thus identified is $\theta''$. The vertical hieght h of the apparatus is then the length of the perpendicular between p and p'.

Figure 11:
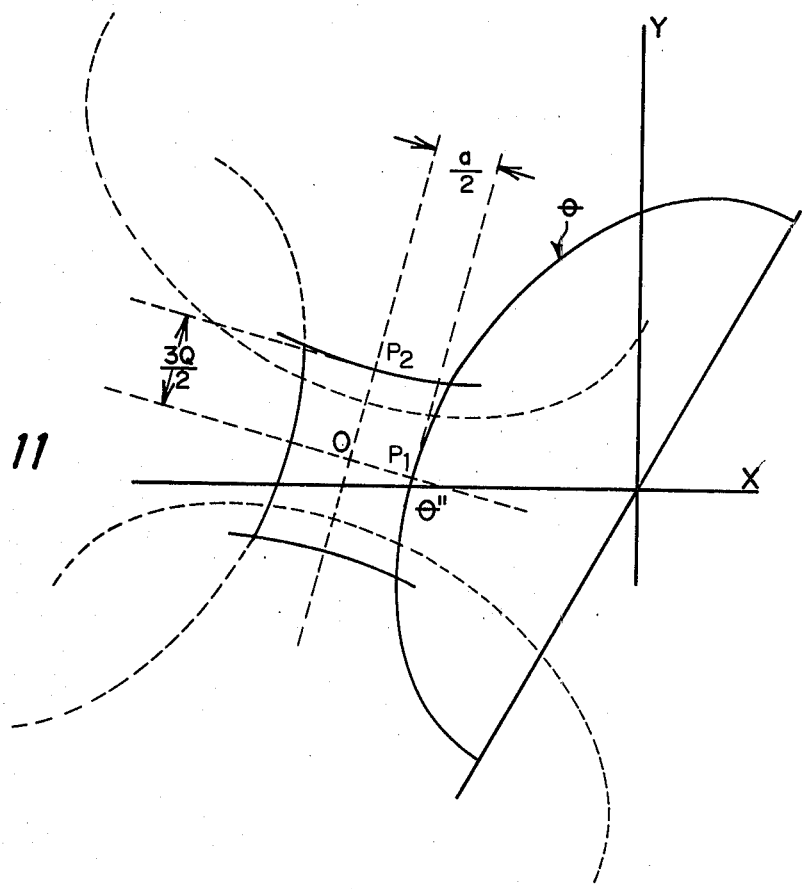

After determining height, it is necessary to determine the configuration of the device at its terminus which will fix the remaining dimensions of the apparatus. The configuration of the terminus is determined in the following manner. First, configuration of the lower area of the apparatus, that is, the area which is defined by a plane which is tangent to the lower dimension of the apparatus, must be determined. As discussed in the later Jenike bulletin, an optimum flow channel will have a rectangular opening with *the major axis three times the minor axis.* The minor axis is normally defined as the width of a rectangular outlet, the side of a square outlet or the diameter of a circular outlet. More specifically, the term outlet here refers to the hopper outlet through which bulk solid material flow is desired. Next, using FIG. 11 which illustrates $\theta$ after rotation and arc segment $\theta''$, a perpendicular bisector $p_1$ of arc segment $\theta''$ is constructed as shown in FIG. 11. Arc segment $\theta''$ is now rotated 90°, 180° and 270° counterclockwise around a point located distance (a)/2 on the perpendicular bisector from the convex surface of $\theta''$. The rotations at 90° and at 270° are then transposed outward along a perpendicular to $p_1$ at 0 to a distance 3(a)/2 from 0. The enclosure thus formed by the intersection of the cycloidal curves establishes the configuration of the invention at its terminus which will have a major axis 3(a) and a minor axis (a).

Figure 12A:
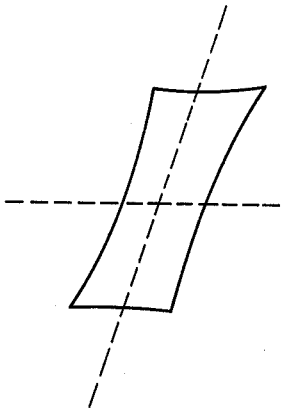
Figure 12B:
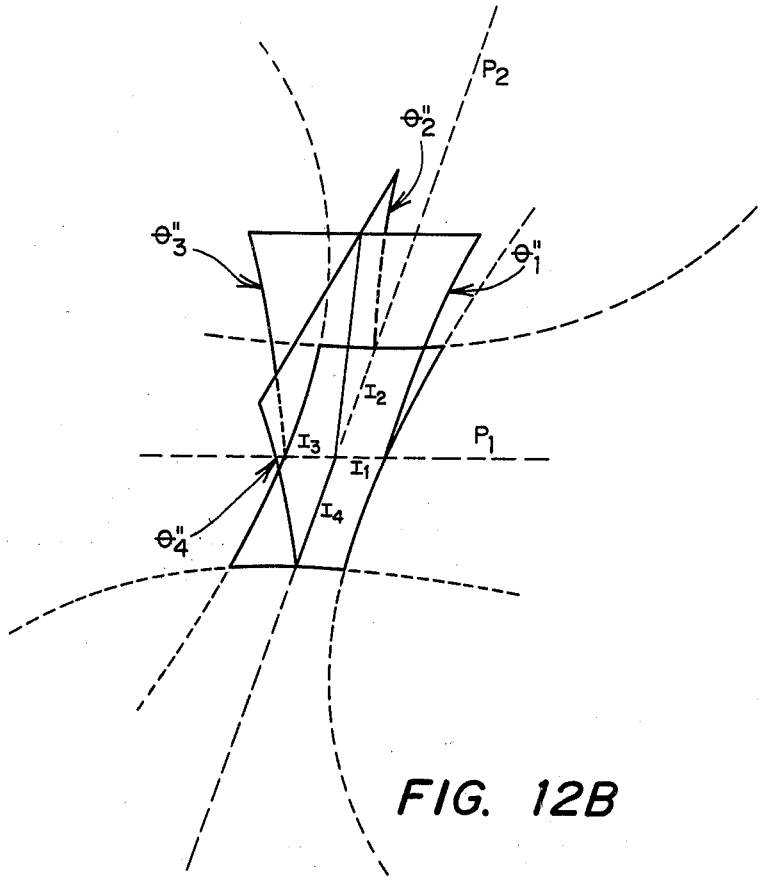
Figure 12C:
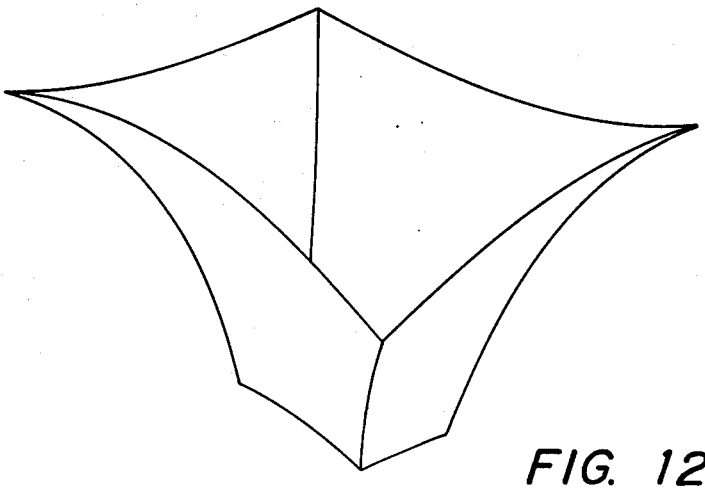

Now it is possible to construct the sides of the apparatus. This may be accomplished in the following manner. Construct, as shown in FIG. 12A, the configuration of the apparatus at its terminus as described above. This configuration will lie in a plane. From this plane, at the points of intersection of the perpendiculars $p_1$ and $p_2$ with *each* of the sides (see FIG. 11), construct arc segment $\theta''$ (the height of the invention as determined in FIG. 10) such that the convex side of the curve $\theta''$ is in each case inward and such that the plane determined by the arc $\theta''$ is perpendicular to the plane of the configuration and in line with the perpendiculars $p_1$ and $p_2$ to each of the sides. Each set of opposing arc segments $\theta''_1$, $\theta''_3$; $\theta''_2$ and $\theta''_4$ will form a plane as shown in FIG. 12B. Now four three-dimensional, curvilinear, cycloidal surfaces are traced in space by causing the cycloidal curves, segments of which form the configuration of the lower terminus of the apparatus, to travel up a respective $\theta''$ such that its normal $\perp_1$, $\perp_2$, $\perp_3$ or $\perp_4$ remains in the same vertical plane and coincides continuously with the normal to $\theta''$ in that plane. Thus there can be traced four cycloidal curves which intersect to form a figure closed on four sides and open on top and bottom. This is the configuration of the apparatus as shown in FIG. 12C.

Figure 12D:
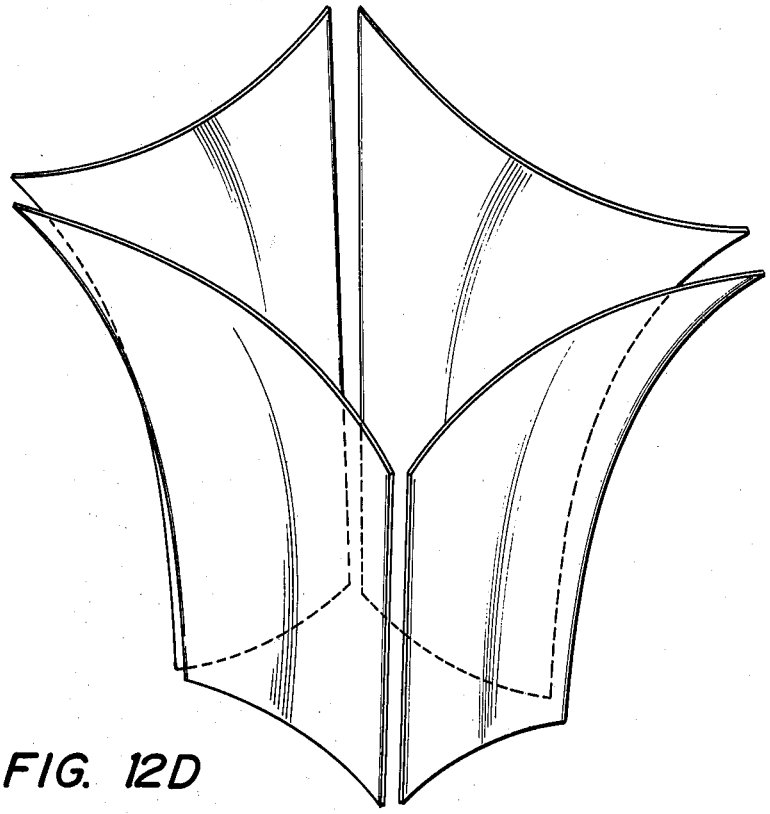
Figure 12E:
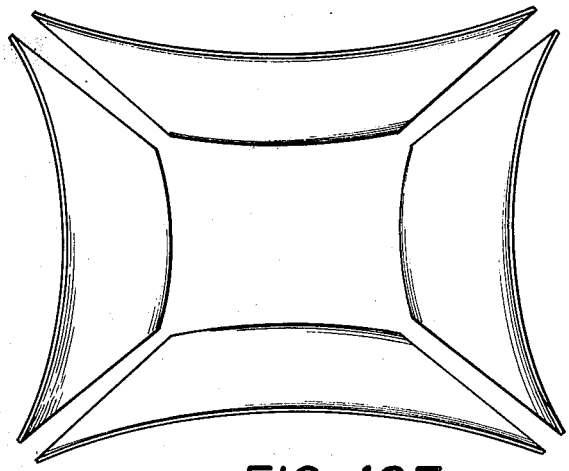

Actually in its preferred embodiment the invention will not form a four-walled figure but rather will have each side separated from the other as shown in FIGS. 12D and 12E. This separation normally would be less than a/8. The apparatus designed as described above is then located in hopper container 3, FIG. 1, such that a plane parallel to its base (the bottom terminus) and bisecting its height h would coincide with plane A and such that its center line would coincide with the center line of container 3.

Apparatus to be used in zone Zb and other zones are constructed in a manner identical to that discussed above except the cross section through the midpoint (vertically) of the apparatus located in the adjacent lower zone is used as the hopper outlet dimension for purposes of calculation of each subsequent apparatus.

Figure 13:
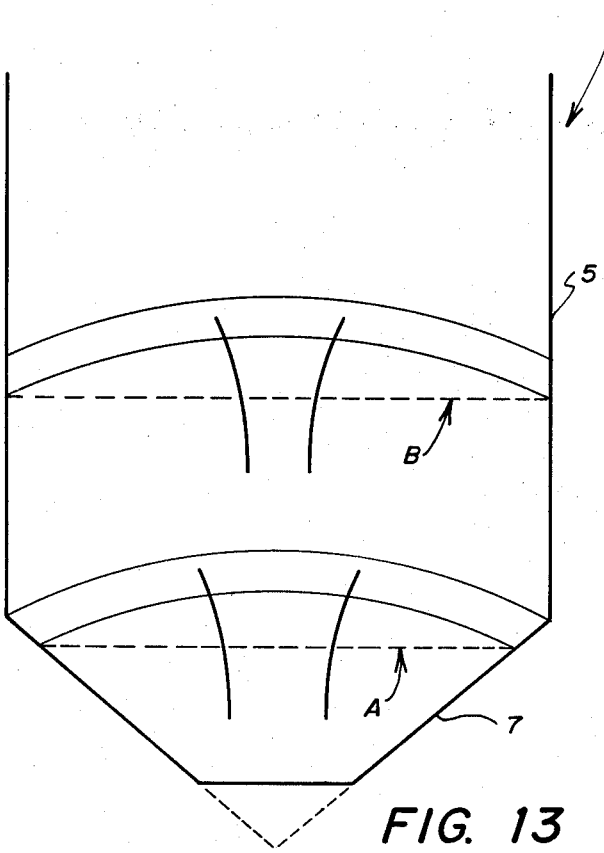
FIG. 13 is a schematic representation of a container having two apparatus embodying the present invention.

FIG. 13 illustrates a container 3 consisting of a bin 5 and hopper 7 with two apparatus constructed and installed in accordance with the invention. Planes A and B represent the planes located at the terminus of the zones of obstruction as described above.

FURTHER DISCUSSION OF PREFERRED EMBODIMENT

The above detailed description represents a sample solution to the problem of bulk solid particle clogging using the present invention. While the above represents the preferred embodiment, it is not intended to restrict the invention to the specifics discussed therein. Generally, a combination of cycloidal surfaces in space ranging from two to many such surfaces is effective in facilitating the flow of bulk solid particles. The method for constructing devices with varying numbers of sides is to vary the degrees through which the cycloidal arc in FIG. 11 is rotated. Further, while a specific cycloid is identified above for any given set of hopper outlet dimensions, cycloids in particular and curvilinear arcs in general may be used to facilitate the flow of bulk solid particles. Likewise, while specific segments of a cycloidal curve were used above more generally a wide range of cycloidal shapes or other curves may be used to generate three-dimensional surfaces which may be combined to facilitate the flow of bulk solid particles, and numerous techniques are available for the generation of three-dimensional curves, whether cycloidal, hyperbolic, parabolic or other. In determining the relative position of the three-dimensional cycloidal surfaces, the "effective yield locus" was utilized. While this is the most effective technique and is therefore preferred, it is by no means the only acceptable technique. Similarly, the "kinematic angle of friction" was used to determine the height of the device. While this is the most effective technique and is therefore preferred, it is likewise by no means the only acceptable technique. Many techniques are available in the literature and known to those experienced in the art for determining the dimensions of a flow channel. In FIG. 11 a relationship of three to one for the major and minor axes is chosen. While this is the most effective and therefore preferred relationship, it is by no means the only effective relationship. Specifically, it may be used only for certain combinations of three-dimensional cycloidal curves. Such a relationship would, for example, be inappropriate for a three-sided container, where another ratio would have to be selected.

By use of the flow facilitating apparatus of the present invention it is possible to utilize containers which have proved impractical for the handling of certain materials without redesign or replacement of the containers.

What is claimed is:

1. An apparatus adapted to be positioned within a container for interrupting a consolidating stress field generated within the container to facilitate the flow of solid particles through the container, which apparatus comprises:

a multisurfaced body the surfaces of which contact said solid particles and are described by curves in both vertical and horizontal directions, the surfaces also converging toward the center and bottom of the container.

2. The apparatus of claim 1 wherein said body has four walls the inner and outer surfaces of which are generated by the curves, the lateral edges of said walls being in proximate abutting relationship.

3. The apparatus of claim 1 wherein said body has four walls the inner and outer peripheries of which are generated by the curves and the lateral edges of which are joined to form an integral body.

4. The apparatus of claim 1 wherein said body has four walls the inner and outer surfaces of which are generated by cycloidal curves, the lateral edges of said walls being in proximate abutting relationship.

5. The apparatus of claim 1 wherein said body has four walls the inner and outer peripheries of which are generated by cycloidal curves and the lateral edges of which are joined to form an integral body.

6. The apparatus of claim 1 wherein said curves are cycloidal curves.

7. The apparatus of claim 6 wherein said cycloidal curves have the same shape.

8. The apparatus of claim 1, including:

means extending outwardly from the apparatus for engagement with the container for supporting said apparatus in the container at a point where, absent the apparatus, an obstruction to flow could form.

* * * * *